US007900371B1

(12) United States Patent
Bullard

(10) Patent No.: US 7,900,371 B1
(45) Date of Patent: Mar. 8, 2011

(54) PERSONAL DRYER APPARATUS

(76) Inventor: B. Wade Bullard, Frisco City, AL (US)

( * ) Notice: Subject to any disclaimer, the term of this patent is extended or adjusted under 35 U.S.C. 154(b) by 237 days.

(21) Appl. No.: 12/172,767

(22) Filed: Jul. 14, 2008

(51) Int. Cl.
*F26B 19/00* (2006.01)

(52) U.S. Cl. ..... 34/202; 34/233; 34/234; 34/235; 34/572

(58) Field of Classification Search ..... 34/201, 34/202, 218, 232, 233, 234, 235, 524, 572
See application file for complete search history.

(56) References Cited

U.S. PATENT DOCUMENTS

| | | | | |
|---|---|---|---|---|
| 3,128,161 | A | 4/1964 | Hudon | |
| 4,871,900 | A | 10/1989 | Hickman | |
| 5,099,587 | A | 3/1992 | Jarosch | |
| D335,352 | S | 5/1993 | Ristine, III | |
| 5,369,892 | A * | 12/1994 | Dhaemers | 34/275 |
| 5,930,912 | A | 8/1999 | Carder | |
| 6,148,539 | A | 11/2000 | Hatfield et al. | |
| 6,681,417 | B2 * | 1/2004 | Brunelle et al. | 4/597 |
| 6,718,650 | B2 | 4/2004 | Ross | |
| 6,962,005 | B1 * | 11/2005 | Khosropour et al. | 34/218 |
| D534,306 | S | 12/2006 | Butler | |

* cited by examiner

*Primary Examiner* — Jiping Lu
(74) *Attorney, Agent, or Firm* — Crossley Patent Law; Mark A. Crossley

(57) ABSTRACT

The personal dryer apparatus provides a full personal enclosure. The apparatus can be positioned as chosen, whether next to a shower or bath or apart from. One door of the apparatus may be selectively removed if complete shower-to-apparatus joining is desired, as the apparatus provides opposite entry and exit. The cap design and interior air delivery and air exit designs provide optimal air flow into, through, and out of the apparatus. The spaced apart nozzles provide multi-levels of air delivery. The apparatus provides temperature controlled heated air. The selectively positioned nozzle openings and fan control provide selectively delivered air flow amounts.

1 Claim, 4 Drawing Sheets

PERSONAL DRYER APPARATUS

BACKGROUND OF THE INVENTION

Whether for convenience, pleasure, or by need due to infirmity, personal body drying devices have been known and appreciated for some time. Various features are provided in the plurality of devices offered. The present apparatus provide features heretofore not known, and, as such, offers improvements to the art.

FIELD OF THE INVENTION

The personal dryer apparatus relates to personal drying devices and more especially to a personal dryer apparatus with full enclosure, entry and exit doors, multi-levels of elongated air delivery nozzles, an original air flow design, and multi-levels of motion sensors for sensing a person's presence for powering the apparatus and for turning off power.

SUMMARY OF THE INVENTION

The general purpose of the personal dryer apparatus, described subsequently in greater detail, is to provide a personal dryer apparatus which has many novel features that result in an improved personal dryer apparatus which is not anticipated, rendered obvious, suggested, or even implied by prior art, either alone or in combination thereof.

To attain this, the personal dryer apparatus provides a full personal enclosure. The apparatus can be positioned as chosen, whether next to a shower or bath or apart therefrom. One door of the apparatus may be selectively removed if complete shower-to-apparatus joining is desired. The apparatus provides opposite entry and exit. The cap design and interior air delivery and air exit designs provide optimal air flow into, through, and out of the apparatus. The spaced apart nozzles provide multi-levels of air delivery. The apparatus provides temperature controlled heated air. The selectively positioned nozzle openings along with the fan control provide selectively delivered air flow amounts.

Thus has been broadly outlined the more important features of the improved personal dryer apparatus so that the detailed description thereof that follows may be better understood and in order that the present contribution to the art may be better appreciated.

An object of the personal dryer apparatus is to provide a full personal enclosure.

Another object of the personal dryer apparatus is to opposite entry and exit.

A further object of the personal dryer apparatus is to provide optimal air flow into, through, and out of the apparatus.

An added object of the personal dryer apparatus is to provide multi-levels of air delivery.

And, an object of the personal dryer apparatus is to provide temperature controlled heated air.

Yet another object of the personal dryer apparatus is to provide selective air flow amount.

A further object of the personal dryer apparatus is to provide motion-sensed on and off function.

These together with additional objects, features and advantages of the improved personal dryer apparatus will be readily apparent to those of ordinary skill in the art upon reading the following detailed description of presently preferred, but nonetheless illustrative, embodiments of the improved personal dryer apparatus when taken in conjunction with the accompanying drawings.

In this respect, before explaining the current embodiments of the improved personal dryer apparatus in detail, it is to be understood that the personal dryer apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved personal dryer apparatus. It is therefore important that the claims be regarded as including such equivalent constructions insofar as they do not depart from the spirit and scope of the personal dryer apparatus. It is also to be understood that the phraseology and terminology employed herein are for purposes of description and should not be regarded as limiting.

DETAILED DESCRIPTION OF THE DRAWINGS

Figure 1:
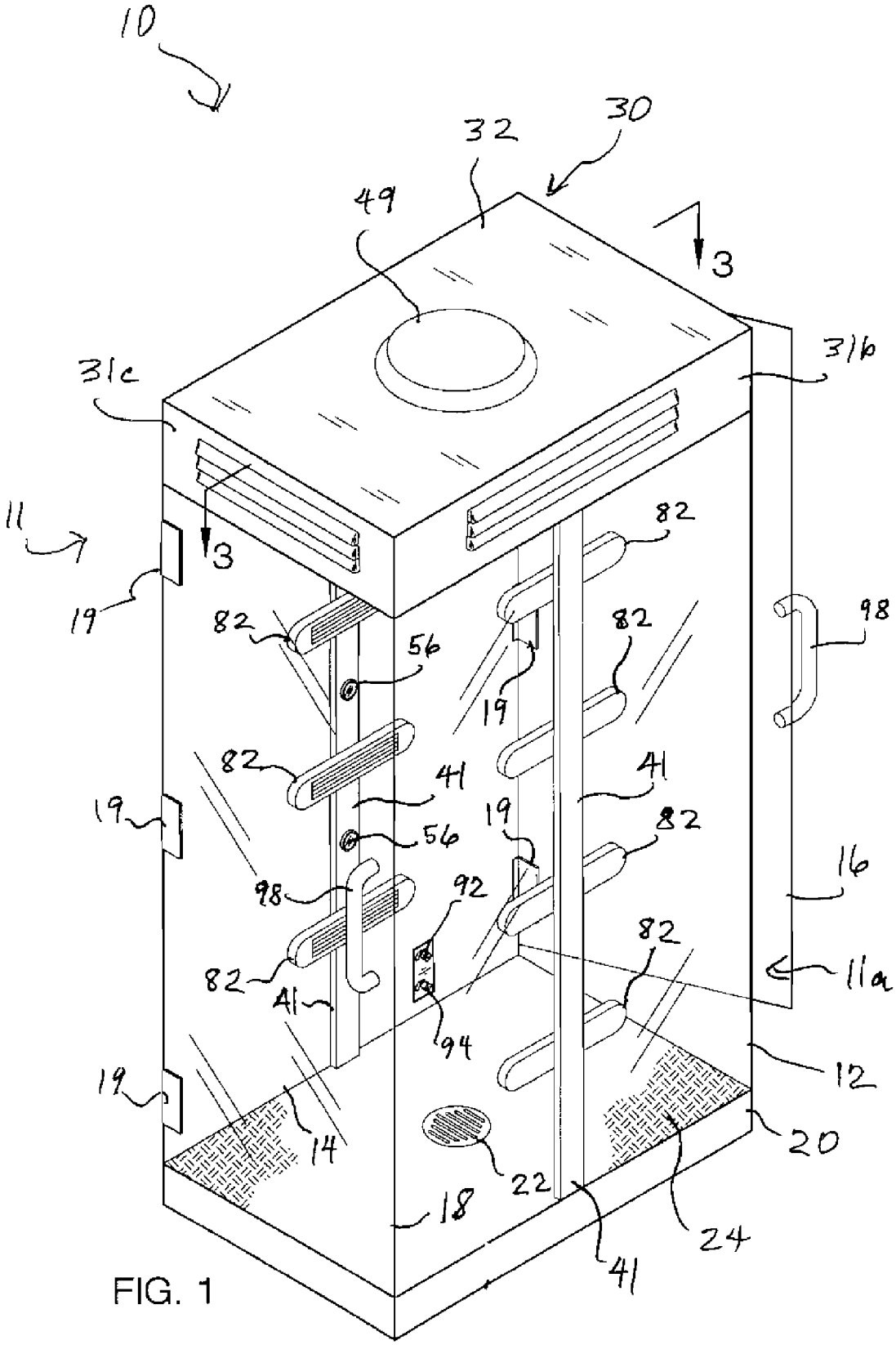
FIG. 1 is a perspective view.
Figure 2:
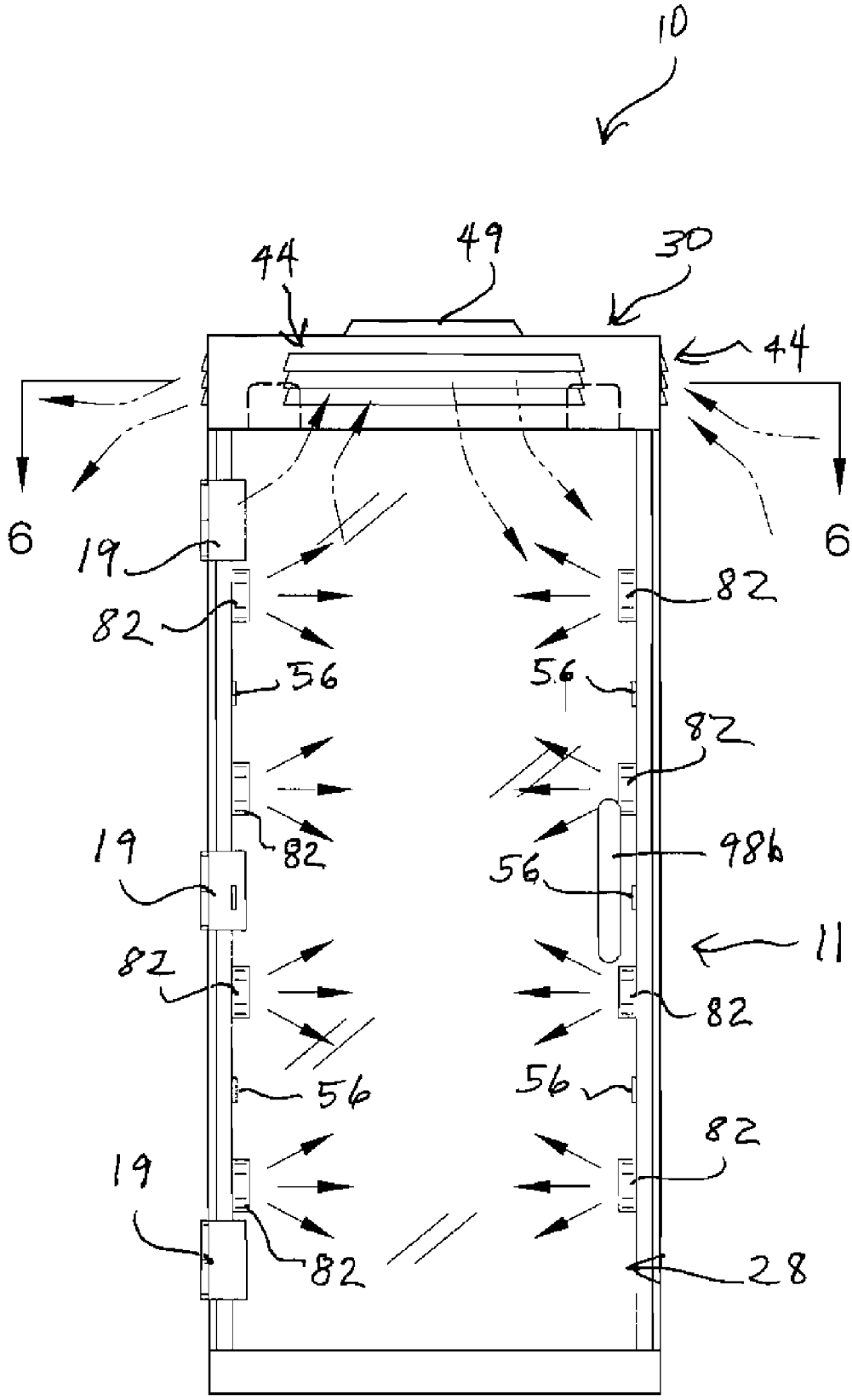
FIG. 2 is an elevation view of the second door side.

With reference now to the drawings, and in particular FIGS. 1 through 6 thereof, the principles and concepts of the personal dryer apparatus generally designated by the reference number 10 will be described.

Referring to FIGS. 1, 2, 4, and 5, the personal dryer apparatus 10 partially comprises a hexagonal enclosure 11 having an interior 11*a*. The enclosure 11 has a first wall 12 spaced apart from a second wall 14. The pair of identical spaced apart doors comprises a first door 16 and a second door 18. Each of the first door 16 and the second door 18 is hingedly connected to the second wall 14 via a plurality of hinges 19. One of each of the pair of identical handles 98 is disposed on the first door 16 and the second door 18, respectively. The base 20 is disposed on a bottom of the enclosure 11. The base 20 is connected to the first wall 12 and the second wall 14. The drain 22 is disposed in an approximate center of the base 20. The non-slip surface 24 is disposed atop the base 20. The pair of identical delivery ducts 41 is disposed within the enclosure 11. One delivery duct 41 is extended vertically along each of the first wall 12 and the second wall 14. The quartet of identical spaced apart elongated delivery nozzles 82 is horizontally disposed along each delivery duct 41. A horizontal shaft 84 is disposed within each nozzle 82. A selectively positioned pivotal opening 86 is affixed to each shaft 84. The fan control 92 is disposed within the enclosure 11. The heat control 94 is disposed within the enclosure 11. The plurality of spaced apart motion sensors 56 is disposed along each delivery duct 41.

Figure 3:
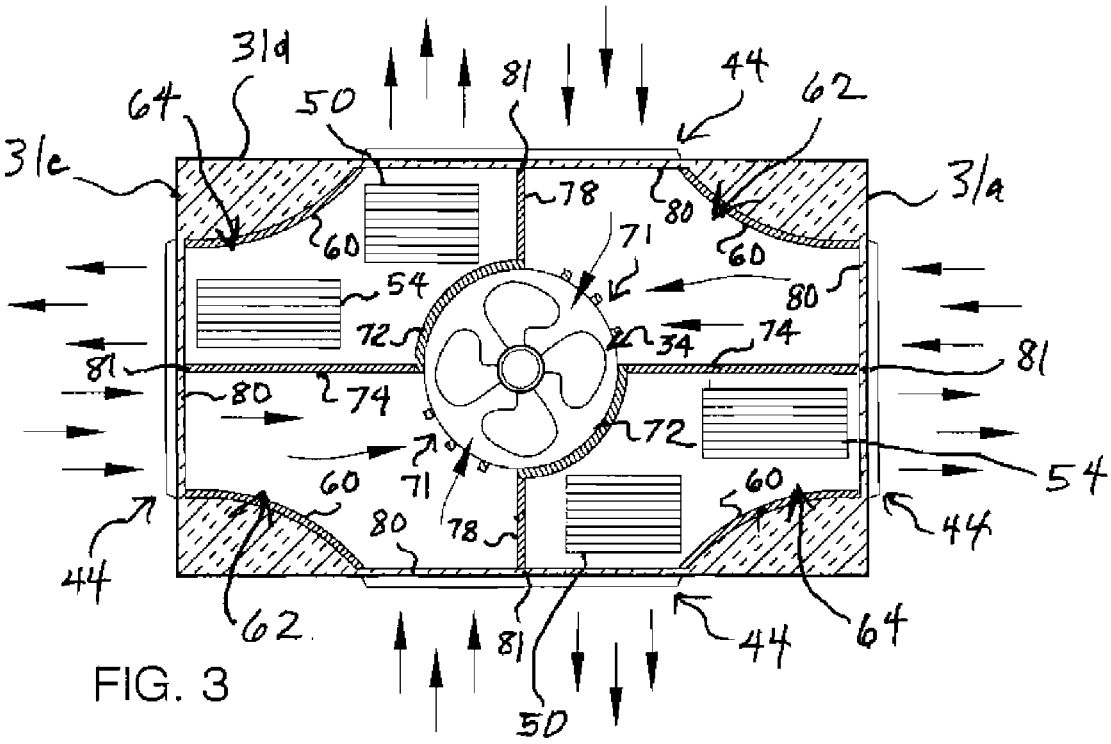
FIG. 3 is a cross sectional view of the upper region of the cap of FIG. 1.
Figure 6:
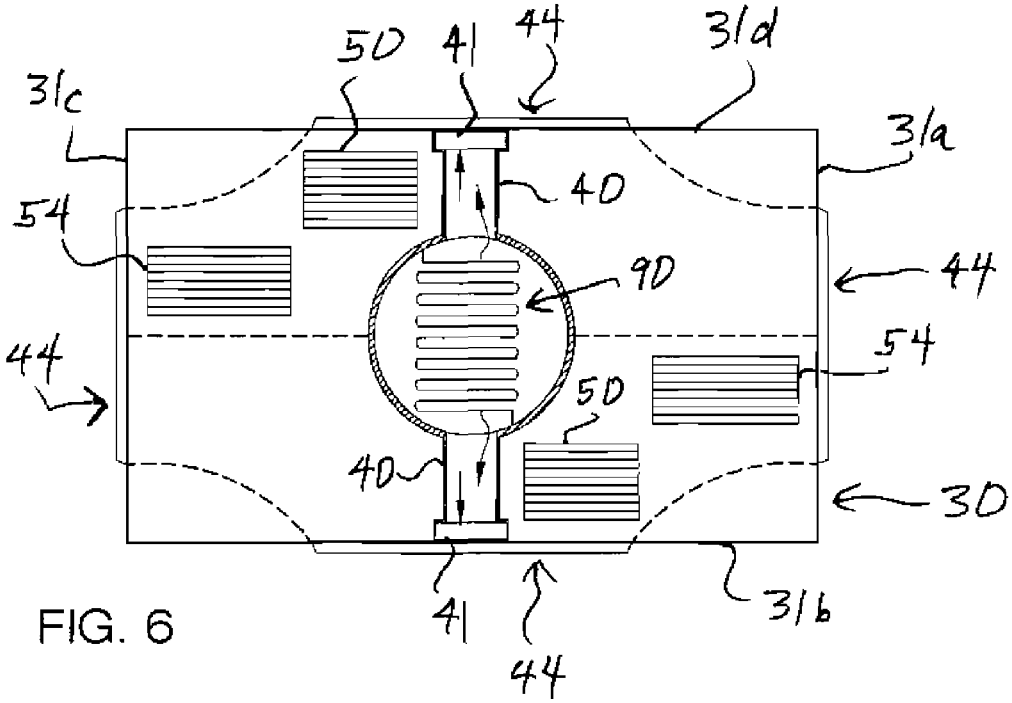
FIG. 6 is a cross sectional view of the cap, the view at a lower elevation than that taken in FIG. 3.
Figure 4:
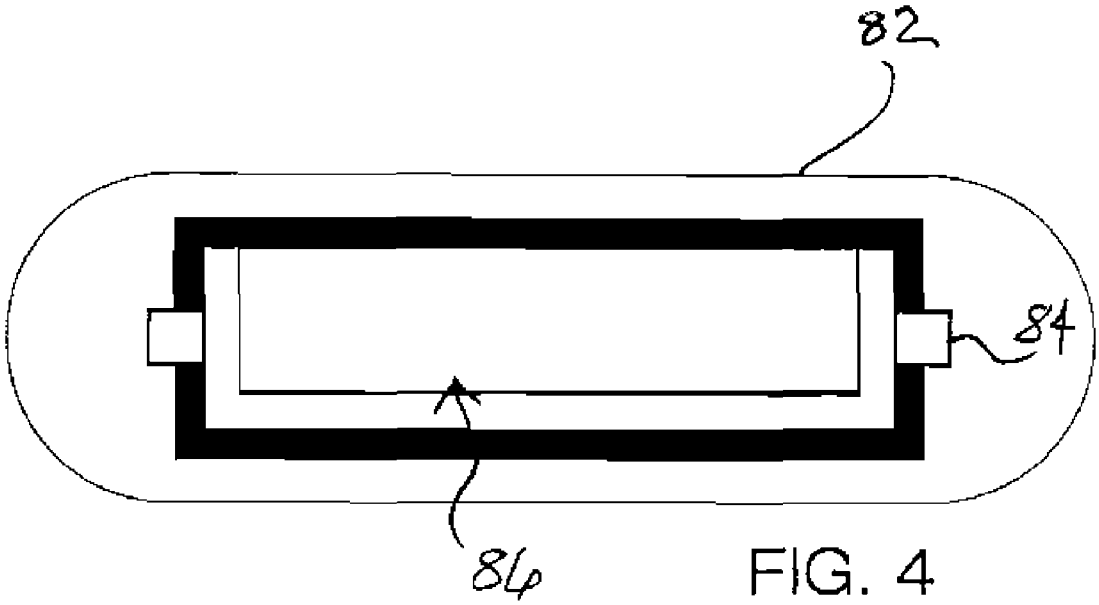
FIG. 4 is an elevation view of an elongated delivery nozzle in the open position.
Figure 5:
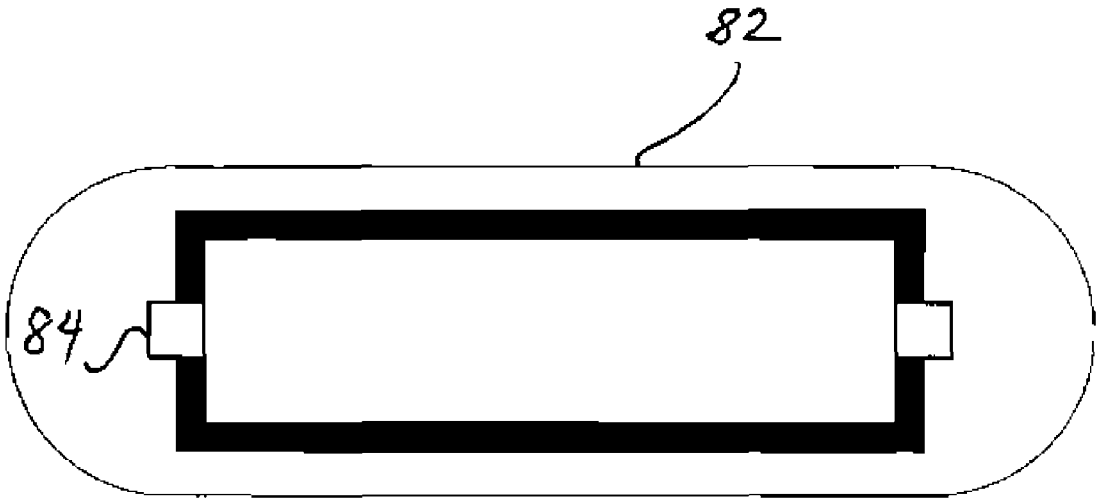
FIG. 5 is an elevation view of an elongated delivery nozzle in the closed position.

Referring to FIGS. 3 and 6, the cap 30 is disposed atop the enclosure 11. The cap 30 comprises a top 32 and four spaced apart sides comprised of the first side 31*a* disposed above the first door 16, the second side 31*b* disposed above the first wall 12, a third side 31*c* disposed above the second door 18, and the fourth side 31*d* disposed above the second wall 14. The fan 34 is disposed in a center of the cap 30 within the fan shroud 49. The fan 34 is in communication with the motion sensors 56 and the fan control 92. The pair of identical spaced apart convex partitions 72 is disposed partially around the fan 34. The pair of identical spaced apart transfer channels 40 is in communication with the fan 34. The heating element 90 is disposed within the shroud 49. The heating element 90 is disposed below the fan 34. The heating element 90 is in communication with the motion sensors 56 and the heat control 94. An identical external vent 44 is disposed within each cap 30 side. An identical porous partition 80 is disposed within each side of the cap 30. Each porous partition 80 is in communication with one external vent 44, respectively. Each porous partition 80 has a midpoint 81. A quartet of identical concave diffusers 60 is disposed within the cap 30. A pair of identical lateral partitions 74 is disposed within the cap 30. Each lateral partition 74 is affixed to one midpoint 81 of one porous partition 80 and to one convex partition 72, respectively. A pair of identical fore to aft partitions 78 is disposed within the cap 30. Each fore to aft partition 78 is affixed to one midpoint 81 of one porous partition 80 and to one convex partition 72, respectively. A pair of identical spaced apart fan openings 71 is disposed within the cap 30. Each fan opening 71 is in communication with one lateral partition 74 and one fore to aft partition 78, respectively. The pair of identical spaced apart open to fan chambers 62 is disposed within the cap 30. Each open to fan chamber 62 moves air into the enclosure interior 11*a*. Each open to fan chamber 62 is outwardly bounded by one concave diffuser 60, one porous partition 80 disposed above one door, one lateral partition 74, one fan opening 71, one fore to aft partition 78, and one porous partition 80 disposed above one wall. A pair of identical spaced apart closed to fan chambers 64 moves air out of the enclosure 11. Each closed to fan chamber 64 is outwardly bounded by one concave diffuser 60, one porous partition 80 above one door, one lateral partition 74, one convex partition 72, one fore to aft partition 78, and one porous partition 80 above one wall. One of a pair of identical rectangular ceiling vents 50 is disposed within each closed to fan chamber 64. One of a pair of identical elongated vents 54 is disposed within each closed to fan chamber 64.

When a user enters the enclosure 11, the motion sensors 56 detect a presence. The user dials the fan control 92 and heat control 94 to the desired setting to operate the apparatus 10. A user may choose to leave the fan control 92 and heat control 94 in the desired setting. Upon user exit from the interior 11*a*, the fan 34 and heating element 90 cease functions until a presence is once again detected by the motion sensors 56. The apparatus 10 is powered by conventional electrical power sources.

With respect to the above description then, it is to be realized that the optimum dimensional relationships for the parts of the personal dryer apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the personal dryer apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the personal dryer apparatus may be used.

Therefore, the foregoing is considered as illustrative only of the principles of the personal dryer apparatus. Further, since numerous modifications and changes will readily occur to those skilled in the art, it is not desired to limit the personal dryer apparatus to the exact construction and operation shown and described, and accordingly, all suitable modifications and equivalents may be resorted to, falling within the scope of the personal dryer apparatus.

What is claimed is:

1. A personal dryer apparatus, comprising, in combination:

a hexagonal enclosure having an interior, the enclosure having a first wall spaced apart from a second wall;

a pair of identical spaced apart doors comprising a first door and a second door, each door hingedly connected to the second wall;

a pair of identical handles, one handle disposed on each door;

a base disposed on a bottom of the enclosure, the base connected to the first wall and the second wall;

a drain disposed in an approximate center of the base;

a non-slip surface atop the base;

a pair of identical delivery ducts disposed within the enclosure, one delivery duct extended vertically along each of the first wall and the second wall, respectively;

a quartet of identical spaced apart elongated delivery nozzles horizontally disposed along each delivery duct;

a horizontal shaft disposed within each nozzle;

a selectively positioned pivotal opening affixed to each shaft;

a fan control disposed within the enclosure;

a heat control disposed within the enclosure;

a plurality of spaced apart motion sensors disposed along each delivery duct;

a cap disposed atop the enclosure, the cap comprising a top and four spaced apart sides comprised of a first side above the first door, a second side above the first wall, a third side above the second door and a fourth side above the second wall;

a fan disposed in a center of the cap within a fan shroud, the fan in communication with the motion sensors and the fan control;

a pair of identical spaced apart convex partitions disposed partially around the fan;

a pair of identical spaced apart transfer channels in communication with the fan;

a heating element disposed within the shroud, the heating element disposed below the fan, the heating element in communication with the motion sensors and the heat control;

an identical external vent disposed within each cap side;

an identical porous partition disposed within each side of the cap, each porous partition in communication with one external vent, respectively, each porous partition having a midpoint;

a quartet of identical concave diffusers disposed within the cap;

a pair of identical lateral partitions disposed within the cap, each lateral partition affixed to one midpoint of one porous partition and to one convex partition, respectively;

a pair of identical fore to aft partitions disposed within the cap, each fore to aft partition affixed to one midpoint of one porous partition and to one convex partition, respectively;

a pair of identical spaced apart fan openings disposed within the cap, each fan opening in communication with one lateral partition and one fore to aft partition, respectively;

a pair of identical spaced apart open to fan chambers moving air into the enclosure interior, each open to fan chamber disposed within the cap, each open-to-fan chamber outwardly bounded by one concave diffuser, one porous partition disposed above one door, one lateral partition, one fan opening, one fore to aft partition, and one porous partition disposed above one wall;

a pair of identical spaced apart closed to fan chambers moving air out of the enclosure, each closed to fan chamber disposed within the cap, each closed to fan partition outwardly bounded by one concave diffuser, one porous partition above one door, one lateral partition, one convex partition, one fore to aft partition, and one porous partition above one wall;

a pair of identical rectangular ceiling vents, one rectangular vent disposed within each closed to fan chamber;

a pair of identical elongated vents, one elongated vent disposed within each closed to fan chamber.

* * * * *